US011261399B2

(12) United States Patent
Lee et al.

(10) Patent No.: US 11,261,399 B2
(45) Date of Patent: Mar. 1, 2022

(54) LUBRICANT COMPOSITION FOR GEAR OIL

(71) Applicant: DL Chemical CO., LTD., Seoul (KR)

(72) Inventors: Hyeung Jin Lee, Daejeon (KR); Kyong Ju Na, Gwangju (KR)

(73) Assignee: DL Chemical CO., LTD., Seoul (KR)

( * ) Notice: Subject to any disclaimer, the term of this patent is extended or adjusted under 35 U.S.C. 154(b) by 0 days.

(21) Appl. No.: 16/680,818

(22) Filed: Nov. 12, 2019

(65) Prior Publication Data

US 2020/0277540 A1 Sep. 3, 2020

(30) Foreign Application Priority Data

Feb. 28, 2019 (KR) ..... 10-2019-0023683

(51) Int. Cl.

| | |
|---|---|
| ***C10M 169/00*** | (2006.01) |
| ***C10M 107/02*** | (2006.01) |
| ***C10M 119/02*** | (2006.01) |
| ***C10M 137/12*** | (2006.01) |
| *C10N 40/04* | (2006.01) |

(52) U.S. Cl.

CPC ..... *C10M 169/00* (2013.01); *C10M 107/02* (2013.01); *C10M 119/02* (2013.01); *C10M 137/12* (2013.01); *C10M 2205/024* (2013.01); *C10M 2205/0206* (2013.01); *C10M 2223/06* (2013.01); *C10N 2040/04* (2013.01)

(58) Field of Classification Search

CPC ..... C10M 137/02; C10M 137/04; C10M 137/12; C10M 2223/02; C10M 2223/04; C10M 2223/06; C10M 169/00; C10M 119/02; C10M 107/02; C10M 2205/0206; C10M 2205/024; C10N 2040/04

See application file for complete search history.

(56) References Cited

U.S. PATENT DOCUMENTS

| | | | | |
|---|---|---|---|---|
| 9,957,460 | B2 | 5/2018 | Qu et al. | |
| 2007/0142659 | A1 | 6/2007 | DeGonia et al. | |
| 2008/0176775 | A1 | 7/2008 | Wright et al. | |
| 2010/0105585 | A1* | 4/2010 | Carey | C10M 141/10 508/162 |
| 2011/0207637 | A1 | 8/2011 | Datta et al. | |
| 2014/0011720 | A1 | 1/2014 | Antzutkin et al. | |
| 2015/0232777 | A1 | 8/2015 | Qu et al. | |
| 2016/0304804 | A1* | 10/2016 | Boesmann | C23F 11/167 |
| 2019/0225911 | A1* | 7/2019 | Sutton | C10M 169/044 |

FOREIGN PATENT DOCUMENTS

| | | | | |
|---|---|---|---|---|
| EP | 2 921 509 | A1 | 9/2015 | |
| EP | 3 569 678 | A1 | 11/2019 | |
| JP | 47-1877 | A | 1/1972 | |
| JP | 2008-37963 | A | 2/2008 | |
| JP | 2010-530447 | A | 9/2010 | |
| JP | 2011-190377 | A | 9/2011 | |
| JP | 2011190377 | A * | 9/2011 | |
| JP | 2013-503957 | A | 2/2013 | |
| JP | 2014-70155 | A | 4/2014 | |
| KR | 10-1347964 | B1 | 1/2014 | |
| KR | 10-1420890 | B1 | 7/2014 | |
| KR | 10-2016-0121566 | A | 10/2016 | |
| RU | 2 418 847 | C2 | 5/2011 | |
| RU | 2 704 028 | C2 | 10/2019 | |
| WO | 2011/099207 | A1 | 8/2011 | |
| WO | 2017/079584 | A1 | 5/2017 | |
| WO | WO-2017083546 | A1 * | 5/2017 | C10M 141/10 |
| WO | 2018/131543 | A1 | 7/2018 | |

OTHER PUBLICATIONS

Communication dated Mar. 13, 2020, issued by the Australian Patent Office in application No. 2019257480.
Communication dated Feb. 22, 2021, issued by the Australian Patent Office in application No. 2019257480.
The Extended European Search Report dated May 29, 2020, issued by the European Patent Office in application No. 19207902.8.
Communication dated Dec. 8, 2020, issued by the Japanese Patent Office in application No. 2019-204556.
Communication dated Mar. 20, 2020, issued by the Federal Service for Intellectual Property in Russian application No. 2019136521/04.
Communication dated Jun. 18, 2020, issued by the Federal Service for Intellectual Property in Russian application No. 2019136521/04.

* cited by examiner

*Primary Examiner* — Taiwo Oladapo
(74) *Attorney, Agent, or Firm* — Sughrue Mion, PLLC

(57) ABSTRACT

The present invention relates to a lubricant composition, and more particularly to a lubricant composition, which includes an ethylene-alphaolefin oligomer and an alkylated phosphonium compound, thus realizing energy reduction and an increased endurance life, and which is thus suitable for use in gear oil. The lubricant composition of the present invention includes a base oil, a liquid olefin copolymer, and an alkylated phosphonium compound.

8 Claims, No Drawings

LUBRICANT COMPOSITION FOR GEAR OIL

CROSS-REFERENCE TO RELATED APPLICATIONS

This application is based on and claims priority from Korean Patent Application No. 10-2019-0023683, filed on Feb. 28, 2019 with the Korean Intellectual Property Office, the disclosure of which is incorporated herein in its entirety by reference.

BACKGROUND OF THE INVENTION

1. Technical Field

The present invention relates to a lubricant composition, and more particularly to a lubricant composition, which includes an ethylene-alphaolefin oligomer and an alkylated phosphonium compound, thus realizing energy reduction and an increased endurance life, and which is thus suitable for use in gear oil.

2. Description of the Related Art

Recently, as environmental problems such as global warming, destruction of the ozone layer, etc. have come to the fore, environmental regulations have become strict. Hence, reduction of carbon dioxide emissions is receiving a great deal of attention. In order to reduce carbon dioxide emissions, it is urgent to decrease energy consumption in vehicles, construction machinery, agricultural machinery and the like, that is, to increase fuel economy, and thus there is a strong demand for measures capable of contributing to energy reduction in an engine, a transmission, a final reducer, a compressor, a hydraulic device and the like. Accordingly, lubricants used in such devices are required to have the ability to decrease stirring resistance or friction resistance compared to conventional cases.

A lubricant is an oily material used to reduce the generation of frictional force on the friction surface of a machine or to dissipate frictional heat generated from the friction surface. The lubricant is manufactured by adding additives to base oil, and is largely classified into a mineral-oil-based lubricant (petroleum-based lubricant) and a synthetic lubricant depending on the type of base oil, the synthetic lubricant being classified into a polyalphaolefin-based lubricant and an ester-based lubricant.

As means for improving fuel economy in gears of transmissions and reducers, decreasing the viscosity of a lubricant is generally used. For example, among transmissions, an automatic transmission or a continuously variable transmission for vehicles has a torque converter, a wet clutch, a gear bearing mechanism, an oil pump, a hydraulic control mechanism, etc., and a manual transmission or a reducer has a gear bearing mechanism, and thus when the viscosity of lubricant used therefor is further decreased, stirring resistance and friction resistance of the torque converter, the wet clutch, the gear bearing mechanism, and the oil pump are decreased, thereby increasing power transmission efficiency, ultimately making it possible to improve the fuel economy of vehicles.

However, when the viscosity of conventional lubricants is lowered, fitting performance is greatly decreased due to the deterioration of friction performance, and sticking or the like occurs, thus causing defects in the transmission or the like. Particularly, in the case of low viscosity, a viscosity modifier is sheared during the use thereof, and thus the viscosity is lowered, so that the wear resistance of the gear is damaged and fitting performance is easily deteriorated. Furthermore, even when a sulfur/phosphorus extreme pressure agent is added to increase the extreme pressure performance of low-viscosity oil, fitting performance and endurance life are remarkably decreased, making it difficult to realize long-term use thereof.

Therefore, the present inventors have developed a lubricant composition for gear oil, which is capable of reducing the mechanical wear of gear parts and energy consumption and also of exhibiting superior thermal stability and oxidation stability, and may thus be industrially used for a long period of time.

CITATION LIST

Patent Literature (Patent Document 0001) Korean Patent No. 10-1420890
(Patent Document 0002) Korean Patent No. 10-1347964

SUMMARY OF THE INVENTION

Accordingly, the present invention has been made keeping in mind the problems encountered in the related art, and an objective of the present invention is to provide a lubricant composition, in which a functional additive for friction reduction and an ethylene-alphaolefin liquid random copolymer are mixed, thereby exhibiting superior friction characteristics, thermal stability and oxidation stability.

Another objective of the present invention is to provide a lubricant composition for gear oil, which is able to reduce the mechanical wear of gear parts and energy consumption when applied to gears of transmissions and reducers, and may be used for a long period of time due to low changes in the physical properties of gear oil.

In order to accomplish the above objectives, the present invention provides a lubricant composition, comprising a base oil, a liquid olefin copolymer, and an alkylated phosphonium compound.

The base oil may be at least one selected from the group consisting of mineral oil, polyalphaolefin (PAO) and ester.

The liquid olefin copolymer may be prepared by copolymerizing ethylene and alphaolefin in the presence of a single-site catalyst system, and the single-site catalyst system preferably includes a metallocene catalyst, an organometallic compound and an ionic compound.

The liquid olefin copolymer may have a coefficient of thermal expansion of 3.0 to 4.0.

In the lubricant composition of the present invention, the liquid olefin copolymer may be included in an amount of 0.1 to 30 wt %, and preferably 0.5 to 25 wt %. The alkylated phosphonium compound may be included in an amount of 0.1 to 5.0 wt %, and preferably 0.3 to 4.0 wt %.

The lubricant composition may have an SRV friction coefficient of 0.2 to 0.3 and a traction coefficient of 0.15 to 0.3. Moreover, the lubricant composition may have a pinion torque loss rate due to friction of less than 1% in an FZG gear efficiency test.

According to the present invention, a lubricant composition includes an alkylated phosphonium compound as a friction-reducing agent, in addition to an existing sulfur/phosphorus extreme pressure agent, thereby maximizing friction performance to thus reduce the mechanical wear of gear parts and energy consumption when applied to gears of transmissions and reducers, ultimately maximizing energy-saving effects.

Also, according to the present invention, the lubricant composition includes, as a viscosity modifier, an olefin copolymer prepared in the presence of a metallocene compound catalyst, and can thus exhibit a high viscosity index and superior low-temperature stability.

Therefore, the present invention can provide a lubricant composition for gear oil, which enables long-term use due to low changes in the physical properties of gear oil.

DESCRIPTION OF SPECIFIC EMBODIMENTS

Hereinafter, a detailed description will be given of the present invention.

The present invention relates to a lubricant composition, which has superior oxidation stability and friction characteristics and is thus suitable for use in gear oil. Hence, the lubricant composition of the present invention includes a base oil, a liquid olefin copolymer, and an alkylated phosphonium compound.

Here, the base oil varies from the aspects of viscosity, heat resistance, oxidation stability and the like depending on the manufacturing method or refining method, but is generally classified into mineral oil and synthetic oil. The API (American Petroleum Institute) classifies base oil into five types, namely Group I, II, III, IV and V. These types, based on API ranges, are defined in API Publication 1509, 15$^{th}$ Edition, Appendix E, April 2002, and are shown in Table 1 below.

TABLE 1

| | Saturated hydrocarbon (%) | Sulfur (%) | Viscosity index |
|---|---|---|---|
| Group I | <90 | >0.03 | 80 ≤ VI < 120 |
| Group II | ≥90 | ≤0.03 | 80 ≤ VI < 120 |
| Group III | ≥90 | ≤0.03 | VI ≥ 120 |
| Group IV | PAO (Poly Alpha Olefin) | | |
| Group V | Ester & Others | | |

In the lubricant composition of the present invention, the base oil may be at least one selected from the group consisting of mineral oil, polyalphaolefin (PAO) and ester, and may be any type among Groups I to V based on the API ranges.

More specifically, mineral oil belongs to Groups I to III based on the API ranges, and mineral oil may include oil resulting from subjecting a lubricant distillate fraction, obtained through atmospheric distillation and/or vacuum distillation of crude oil, to at least one refining process of solvent deasphalting, solvent extraction, hydrogenolysis, solvent dewaxing, catalytic dewaxing, hydrorefining, sulfuric acid cleaning, and white clay treatment; wax isomerized mineral oil; or a gas-to-liquid (GLT) oil obtained via the Fischer-Tropsch process.

The synthetic oil belongs to Group IV or V based on the API ranges, and polyalphaolefin belonging to Group IV may be obtained through oligomerization of a higher alphaolefin using an acid catalyst, as disclosed in U.S. Pat. Nos. 3,780,128, 4,032,591, Japanese Patent Application Publication No. Hei. 1-163136, and the like, but the present invention is not limited thereto.

Examples of the synthetic oil belonging to Group V include alkyl benzenes, alkyl naphthalenes, isobutene oligomers or hydrides thereof, paraffins, polyoxy alkylene glycol, dialkyl diphenyl ether, polyphenyl ether, ester, and the like.

Here, the alkyl benzenes and alkyl naphthalenes are usually dialkylbenzene or dialkylnaphthalene having an alkyl chain length of 6 to 14 carbon atoms, and the alkyl benzenes or alkyl naphthalenes are prepared through Friedel-Crafts alkylation of benzene or naphthalene with olefin. The alkylated olefin used in the preparation of alkyl benzenes or alkyl naphthalenes may be linear or branched olefins or combinations thereof.

Also, examples of the ester include, but are not limited to, ditridecyl glutarate, di-2-ethylhexyl adipate, diisodecyl adipate, ditridecyl adipate, di-2-ethylhexyl sebacate, tridecyl pelargonate, di-2-ethylhexyl adipate, di-2-ethylhexyl azelate, trimethylolpropane caprylate, trimethylolpropane pelargonate, trimethylolpropane triheptanoate, pentaerythritol 2-ethylhexanoate, pentaerythritol pelargonate, pentaerythritol tetraheptanoate, and the like.

In the lubricant composition of the present invention, the liquid olefin copolymer is prepared by copolymerizing ethylene and alphaolefin monomers in the presence of a single-site catalyst system in order to uniformly distribute alphaolefin units in the copolymer chain. Preferably, the liquid olefin copolymer is prepared by reacting ethylene and alphaolefin monomers in the presence of a single-site catalyst system including a crosslinked metallocene compound, an organometallic compound, and an ionic compound for forming an ion pair through reaction with the crosslinked metallocene compound.

Here, the metallocene compound included in the single-site catalyst system may be at least one selected from the group consisting of Chemical Formulas 1 to 6 below.

[Chemical Formula 1]

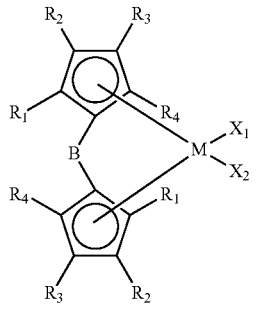

[Chemical Formula 2]

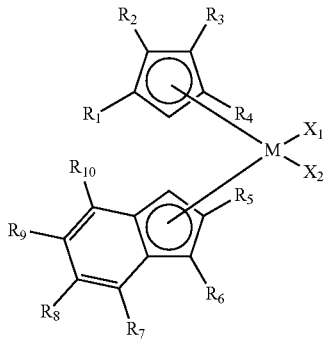

-continued

[Chemical Formula 3]

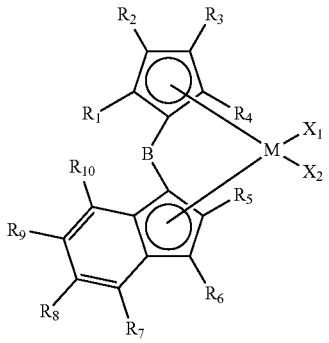

[Chemical Formula 4]

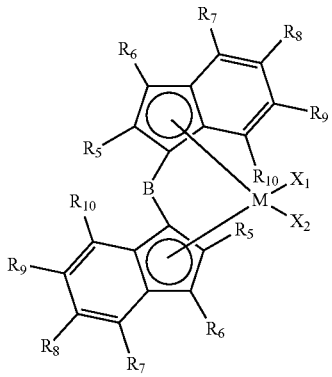

In Chemical Formulas 1 to 4,

M is a transition metal selected from the group consisting of titanium, zirconium, and hafnium, B is absent or is a linking group including a C1-C20 alkylene group, a C6-C20 arylene group, C1-C20 dialkyl silicon, C1-C20 dialkyl germanium, a C1-C20 alkylphosphine group or a C1-C20 alkylamine group, $X_1$ and $X_2$, which are the same as or different from each other, are each independently a halogen atom, a C1-C20 alkyl group, a C2-C20 alkenyl group, a C2-C20 alkynyl group, a C6-C20 aryl group, a C7-C40 alkylaryl group, a C7-C40 arylalkyl group, a C1-C20 alkylamido group, a C6-C20 arylamido group, a C1-C20 alkylidene group or a C1-C20 alkoxy group, and $R_1$ to $R_{10}$, which are the same as or different from each other, are each independently hydrogen, a C1-C20 alkyl group, a C2-C20 alkenyl group, a C6-C20 aryl group, a C7-C20 alkylaryl group, a C7-C20 arylalkyl group, a C5-C60 cycloalkyl group, a C4-C20 heterocyclic group, a C1-C20 alkynyl group, a C6-C20-aryl-containing hetero group or a silyl group.

[Chemical Formula 5]

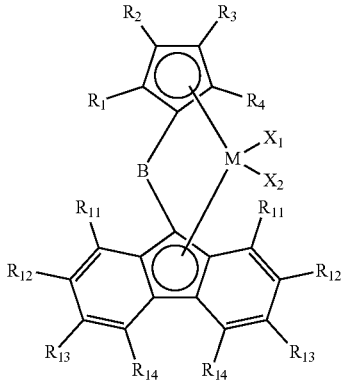

[Chemical Formula 6]

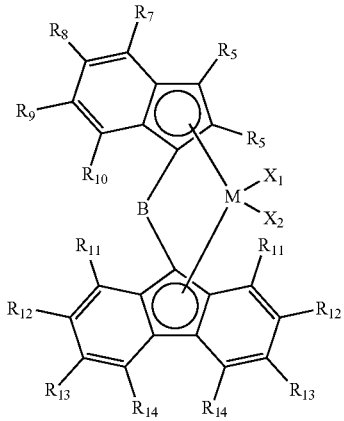

In Chemical Formulas 5 and 6,

M is a transition metal selected from the group consisting of titanium, zirconium, and hafnium, B is absent or is a linking group including a C1-C20 alkylene group, a C6-C20 arylene group, a C1-C20 dialkyl silicon, a C1-C20 dialkyl germanium, a C1-C20 alkylphosphine group or a C1-C20 alkylamine group, $X_1$ and $X_2$, which are the same as or different from each other, are each independently a halogen atom, a C1-C20 alkyl group, a C2-C20 alkenyl group, a C2-C20 alkynyl group, a C6-C20 aryl group, a C7-C40 alkylaryl group, a C7-C40 arylalkyl group, a C1-C20 alkylamido group, a C6-C20 arylamido group, a C1-C20 alkylidene group or a C1-C20 alkoxy group, and $R_1$ to $R_{10}$, which are the same as or different from each other, are each independently hydrogen, a C1-C20 alkyl group, a C2-C20 alkenyl group, a C6-C20 aryl group, a C7-C20 alkylaryl group, a C7-C20 arylalkyl group, a C5-C60 cycloalkyl group, a C4-C20 heterocyclic group, a C1-C20 alkynyl group, a C6-C20-aryl-containing hetero group or a silyl group.

Furthermore, all of $R_{11}$, $R_{13}$ and $R_{14}$ are hydrogen, and each of $R_{12}$ radicals, which are the same as or different from each other, may independently be hydrogen, a C1-C20 alkyl group, a C2-C20 alkenyl group, a C6-C20 aryl group, a C7-C20 alkylaryl group, a C7-C20 arylalkyl group, a C5-C60 cycloalkyl group, a C4-C20 heterocyclic group, a C1-C20 alkynyl group, a C6-C20-aryl-containing hetero group or a silyl group.

Also, the metallocene compound of Chemical Formulas 2 to 6 may include a compound substituted through a hydroaddition reaction, and a preferred example thereof includes dimethylsilyl bis(tetrahydroindenyl) zirconium dichloride.

The organometallic compound included in the single-site catalyst system may be at least one selected from the group consisting of an organoaluminum compound, an organomagnesium compound, an organozinc compound and an organolithium compound, and is preferably an organoaluminum compound. The organoaluminum compound may be at least one selected from the group consisting of, for example, trimethylaluminum, triethylaluminum, triisobutylaluminum, tripropylaluminum, tributylaluminum, dimethylchloroaluminum, dimethylisobutylaluminum, dimethylethylaluminum, diethylchloroaluminum, triisopropylaluminum, triisobutylaluminum, tricyclopentylaluminum, tripentylaluminum, triisopentylaluminum, ethyldimethylaluminum, methyldiethylaluminum, triphenylaluminum, methylaluminoxane, ethylaluminoxane, isobutylaluminoxane and butylaluminoxane, and is preferably triisobutylaluminum.

The ionic compound included in the single-site catalyst system may be at least one selected from the group consisting of organoboron compounds such as dimethylanilinium tetrakis(perfluorophenyl)borate, triphenylcarbenium tetrakis (perfluorophenyl)borate, and the like.

The component ratio of the single-site catalyst system may be determined in consideration of catalytic activity, and the molar ratio of metallocene catalyst:ionic compound: organometallic compound is preferably adjusted in the range of 1:1:5 to 1:10:1000 in order to ensure desired catalytic activity.

Furthermore, the components of the single-site catalyst system may be added at the same time or in any sequence to an appropriate solvent and may thus function as an active catalyst system. Here, the solvent may include, but is not limited to, a hydrocarbon solvent such as pentane, hexane, heptane, etc., or an aromatic solvent such as benzene, toluene, xylene, etc., and any solvent usable in the preparation may be used.

Also, the alphaolefin monomer used in the preparation of the liquid olefin copolymer includes a C2-C20 aliphatic olefin, and may specifically be at least one selected from the group consisting of ethylene, propylene, 1-butene, 1-pentene, 3-methyl-1-butene, 1-hexene, 4-methyl-1-pentene, 3-methyl-1-pentene, 1-heptene, 1-octene, 1-decene, 1-dodecene and 1-tetradecene, and may include isomeric forms, but the present invention is not limited thereto. In the copolymerization, the monomer content is 1 to 95 mol %, preferably 5 to 90 mol %.

The liquid olefin copolymer required in the present invention has a coefficient of thermal expansion of 3.0 to 4.0 and a bromine number of 0.1 or less.

The liquid olefin copolymer may be included in an amount of 0.1 to 30 wt %, and preferably 0.5 to 25 wt %, based on 100 wt % of the lubricant composition. If the amount of the liquid olefin copolymer is less than 0.1 wt % based on 100 wt % of the lubricant composition, low-temperature stability may deteriorate. On the other hand, if the amount thereof exceeds 30 wt %, sufficient viscosity cannot be realized, and thus application of the resulting composition to gear oil becomes difficult, which is undesirable.

The alkylated phosphonium compound, serving as a friction-reducing agent, may be at least one selected from the group consisting of tetraoctylated phosphonium bisethylhexyl phosphate, tributyltetradecylphosphonium bis(2-ethylhexyl)phosphate, tetraethylphosphonium bis(2-ethylhexyl)phosphate and tributylphosphonium bis(2-ethylhexly) phosphate. When the alkylated phosphonium compound is included in the lubricant composition, it may exhibit synergistic effects with an existing wear-resistant agent and friction reduction effects, and additionally, energy-saving effects may be achieved through friction reduction.

The alkylated phosphonium compound may be included in an amount of 0.1 to 5.0 wt %, and preferably 0.3 to 4.0 wt %, based on 100 wt % of the lubricant composition. If the amount of the alkylated phosphonium compound is less than 0.1 wt % based on 100 wt % of the lubricant composition, the friction reduction effect is insignificant. On the other hand, if the amount thereof exceeds 5.0 wt %, the additional reduction effect is insignificant despite the excessive addition thereof, which is undesirable.

The lubricant composition of the present invention may further include an additive selected from the group consisting of an antioxidant, a metal cleaner, an anticorrosive agent, a foam inhibitor, a pour-point depressant, a viscosity modifier, a wear-resistant agent and combinations thereof.

The antioxidant may be included in an amount of 0.01 to 5.0 wt % based on 100 wt % of the lubricant composition, and is preferably used in the form of a mixture of a phenolic antioxidant and an aminic antioxidant, more preferably a mixture of 0.01 to 3.0 wt % of the phenolic antioxidant and 0.01 to 3.0 wt % of the aminic antioxidant.

The phenolic antioxidant may be any one selected from the group consisting of 2,6-dibutylphenol, hindered bisphenol, high-molecular-weight hindered phenol, and hindered phenol with thioether.

The aminic antioxidant may be any one selected from the group consisting of diphenylamine, alkylated diphenylamine and naphthylamine, and preferably, the alkylated diphenylamine is dioctyldiphenylamine, octylated diphenylamine, or butylated diphenylamine.

The metal cleaner may be at least one selected from the group consisting of metallic phenate, metallic sulfonate, and metallic salicylate, and preferably, the metal cleaner is included in an amount of 0.1 to 10.0 wt % based on 100 wt % of the lubricant composition.

The anticorrosive agent may be a benzotriazole derivative, and is preferably any one selected from the group consisting of benzotriazole, 2-methylbenzotriazole, 2-phenylbenzotriazole, 2-ethylbenzotriazole and 2-propylbenzotriazole. The anticorrosive agent may be included in an amount of 0 to 4.0 wt % based on 100 wt % of the lubricant composition.

The foam inhibitor may be polyoxyalkylene polyol, and preferably, the foam inhibitor is included in an amount of 0 to 4.0 wt % based on 100 wt % of the lubricant composition.

The pour-point depressant may be poly(methyl methacrylate), and preferably, the pour-point depressant is included in an amount of 0.01 to 5.0 wt % based on 100 wt % of the lubricant composition.

The viscosity modifier may be polyisobutylene or polymethacrylate, and preferably, the viscosity modifier is included in an amount of 0 to 15 wt % based on 100 wt % of the lubricant composition.

The wear-resistant agent may be at least one selected from the group consisting of organic borates, organic phosphites, organic sulfur-containing compounds, zinc dialkyl dithiophosphate, zinc diaryl dithiophosphate and phosphosulfurized hydrocarbon, and preferably, the wear-resistant agent is included in an amount of 0.01 to 3.0 wt %.

The lubricant composition of the present invention has an SRV friction coefficient of 0.2 to 0.3 and a traction coefficient of 0.15 to 0.3. Also, the lubricant composition of the present invention has a pinion torque loss rate due to friction of less than 1%, as measured through an FZG gear efficiency test as a gear oil rig test.

A better understanding of the present invention through the following examples. However, the present invention is not limited to these examples, but may be embodied in other forms. These examples are provided to thoroughly explain the invention and to sufficiently transfer the spirit of the present invention to those skilled in the art.

1. Preparation of Additive Composition

An additive composition for use in the lubricant composition of the present invention was prepared as shown in Table 2 below.

TABLE 2

| Additive composition | | Composition A | Composition B |
|---|---|---|---|
| Antioxidant | 2,6-dibutylphenol | 1 | 1.5 |
| | Diphenylamine | 0.8 | 1 |
| Metal cleaner | Metallic phenate | 0.2 | 0.6 |
| Anticorrosive agent | Benzotriazole | 0.3 | 1.0 |
| Foam inhibitor | Polyoxyalkylene polyol | 0.01 | 0.02 |
| Pour-point depressant | Polymethylmethacrylate | 0.2 | 0.5 |
| Viscosity modifier | Polyisobutylene | 1.0 | |
| Wear-resistant agent | Zinc diaryl dithiophosphate | 0.2 | 1.1 |

2. Liquid Olefin Copolymer

A liquid olefin copolymer was prepared using an oligomerization method through a catalytic reaction process. Depending on the reaction time and conditions, which follow, liquid olefin copolymers having different molecular weights were prepared, and the properties thereof are shown in Table 3 below.

The reaction time and conditions were increased by 4 hr each from 20 hr. Here, the amounts of hydrogen and comonomer C3, which were added thereto, were increased by 10% each, and polymerization was performed under individual conditions, and the resulting polymers were classified depending on the molecular weight thereof.

TABLE 3

| Alphaolefin copolymer | Main properties | | |
|---|---|---|---|
| | Evaporation Loss (%) | Thickening Power (10 wt % in 150N) | CoE of Thermal Expansion |
| Copolymer I | 1.28 | 6 | 3.00 to 3.20 |
| Copolymer II | 0.54 | 7 | 3.20 to 3.40 |
| Copolymer III | 0.10 | 8 | 3.40 to 3.50 |
| Copolymer IV | 0.001 | 10 | 3.50 to 3.60 |
| Copolymer V | 0.0001 | 12 | 3.60 to 3.70 |
| Copolymer VI | 0.00001 | 14 | 3.70 to 3.80 |

3. Preparation of Lubricant Composition for Gear Oil

A lubricant composition was prepared by mixing a base oil, the liquid olefin copolymer, an alkylated phosphonium compound, and the additive prepared above, as shown in Tables 4 and 5 below. Here, the base oil was polyalphaolefin (PAO 4 cSt, available from Chevron Philips) having kinematic viscosity of 4 cSt at 100° C., and the alkylated phosphonium compound was tetraoctylated phosphonium bisethylhexyl phosphate.

Preparation Examples 1 to 72 and Comparative Examples 1 to 9. Lubricant Composition for Gear Oil Including Additive A

TABLE 4

| Composition | Base oil | Alphaolefin copolymer | Alkylated phosphonium compound | Additive A |
|---|---|---|---|---|
| Preparation Example 1 | 97.14 | Copolymer I 0.05 | 0.1 | 2.71 |
| Preparation Example 2 | 96.74 | Copolymer I 0.05 | 0.5 | 2.71 |
| Preparation Example 3 | 96.24 | Copolymer I 0.05 | 1.0 | 2.71 |
| Preparation Example 4 | 94.24 | Copolymer I 0.05 | 3.0 | 2.71 |
| Preparation Example 5 | 92.24 | Copolymer I 0.05 | 5.0 | 2.71 |
| Preparation Example 6 | 95.79 | Copolymer I 0.5 | 1.0 | 2.71 |
| Preparation Example 7 | 93.79 | Copolymer I 0.5 | 3.0 | 2.71 |
| Preparation Example 8 | 91.79 | Copolymer I 5 | 0.5 | 2.71 |
| Preparation Example 9 | 89.29 | Copolymer I 5 | 3.0 | 2.71 |
| Preparation Example 10 | 87.29 | Copolymer I 5 | 5.0 | 2.71 |
| Preparation Example 11 | 86.79 | Copolymer I 10 | 0.5 | 2.71 |
| Preparation Example 12 | 86.29 | Copolymer I 10 | 1.0 | 2.71 |
| Preparation Example 13 | 82.29 | Copolymer I 10 | 5.0 | 2.71 |
| Preparation Example 14 | 76.79 | Copolymer I 20 | 0.5 | 2.71 |
| Preparation Example 15 | 72.29 | Copolymer I 20 | 5.0 | 2.71 |
| Preparation Example 16 | 67.19 | Copolymer I 30 | 0.1 | 2.71 |
| Preparation Example 17 | 62.29 | Copolymer I 30 | 5.0 | 2.71 |
| Preparation Example 18 | 61.79 | Copolymer I 35 | 0.5 | 2.71 |
| Preparation Example 19 | 61.29 | Copolymer I 35 | 1.0 | 2.71 |
| Preparation Example 20 | 59.29 | Copolymer I 35 | 3.0 | 2.71 |
| Preparation Example 21 | 57.29 | Copolymer I 35 | 5.0 | 2.71 |
| Preparation Example 22 | 52.29 | Copolymer I 35 | 10.0 | 2.71 |
| Preparation Example 23 | 97.14 | Copolymer II 0.05 | 0.1 | 2.71 |
| Preparation Example 24 | 96.74 | Copolymer II 0.05 | 0.5 | 2.71 |
| Preparation Example 25 | 96.24 | Copolymer II 0.05 | 1.0 | 2.71 |
| Preparation Example 26 | 94.24 | Copolymer II 0.05 | 3.0 | 2.71 |
| Preparation Example 27 | 92.24 | Copolymer II 0.05 | 5.0 | 2.71 |
| Preparation Example 28 | 95.79 | Copolymer II 0.5 | 1.0 | 2.71 |
| Preparation Example 29 | 93.79 | Copolymer II 0.5 | 3.0 | 2.71 |
| Preparation Example 30 | 91.79 | Copolymer II 5 | 0.5 | 2.71 |
| Preparation Example 31 | 91.29 | Copolymer II 5 | 1.0 | 2.71 |
| Preparation Example 32 | 87.29 | Copolymer II 5 | 5.0 | 2.71 |
| Preparation Example 33 | 87.19 | Copolymer II 10 | 0.1 | 2.71 |
| Preparation Example 34 | 86.29 | Copolymer II 10 | 1.0 | 2.71 |
| Preparation Example 35 | 84.29 | Copolymer II 10 | 3.0 | 2.71 |

TABLE 4-continued

| Composition | Base oil | Alphaolefin copolymer | Alkylated phosphonium compound | Additive A |
|---|---|---|---|---|
| Preparation Example 36 | 82.29 | Copolymer II 10 | 5.0 | 2.71 |
| Preparation Example 37 | 77.19 | Copolymer II 20 | 0.1 | 2.71 |
| Preparation Example 38 | 74.29 | Copolymer II 20 | 3.0 | 2.71 |
| Preparation Example 39 | 72.29 | Copolymer II 20 | 5.0 | 2.71 |
| Preparation Example 40 | 67.19 | Copolymer II 30 | 0.1 | 2.71 |
| Preparation Example 41 | 97.14 | Copolymer III 0.05 | 0.1 | 2.71 |
| Preparation Example 42 | 96.74 | Copolymer III 0.05 | 0.5 | 2.71 |
| Preparation Example 43 | 96.24 | Copolymer III 0.05 | 1.0 | 2.71 |
| Preparation Example 44 | 94.24 | Copolymer III 0.05 | 3.0 | 2.71 |
| Preparation Example 45 | 91.79 | Copolymer III 5 | 0.5 | 2.71 |
| Preparation Example 46 | 87.29 | Copolymer III 5 | 5.0 | 2.71 |
| Preparation Example 47 | 86.79 | Copolymer III 10 | 0.5 | 2.71 |
| Preparation Example 48 | 82.29 | Copolymer III 10 | 5.0 | 2.71 |
| Preparation Example 49 | 76.79 | Copolymer III 20 | 0.5 | 2.71 |
| Preparation Example 50 | 76.29 | Copolymer III 20 | 1.0 | 2.71 |
| Preparation Example 51 | 72.29 | Copolymer III 20 | 5.0 | 2.71 |
| Preparation Example 52 | 92.19 | Copolymer IV 5 | 0.1 | 2.71 |
| Preparation Example 53 | 89.29 | Copolymer IV 5 | 3.0 | 2.71 |
| Preparation Example 54 | 87.29 | Copolymer IV 5 | 5.0 | 2.71 |
| Preparation Example 55 | 82.29 | Copolymer IV 5 | 10.0 | 2.71 |
| Preparation Example 56 | 86.79 | Copolymer IV 10 | 0.5 | 2.71 |
| Preparation Example 57 | 74.29 | Copolymer IV 20 | 3.0 | 2.71 |
| Preparation Example 58 | 76.79 | Copolymer IV 20 | 0.5 | 2.71 |
| Preparation Example 59 | 91.79 | Copolymer V 5 | 0.5 | 2.71 |
| Preparation Example 60 | 86.79 | Copolymer V 10 | 0.5 | 2.71 |
| Preparation Example 61 | 82.29 | Copolymer V 10 | 5.0 | 2.71 |
| Preparation Example 62 | 77.19 | Copolymer V 20 | 0.1 | 2.71 |
| Preparation Example 63 | 76.79 | Copolymer V 20 | 0.5 | 2.71 |
| Preparation Example 64 | 72.29 | Copolymer V 20 | 5.0 | 2.71 |
| Preparation Example 65 | 67.19 | Copolymer V 30 | 0.1 | 2.71 |
| Preparation Example 66 | 66.79 | Copolymer V 30 | 0.5 | 2.71 |
| Preparation Example 67 | 97.14 | Copolymer VI 0.05 | 0.1 | 2.71 |
| Preparation Example 68 | 96.74 | Copolymer VI 0.05 | 0.5 | 2.71 |
| Preparation Example 69 | 96.24 | Copolymer VI 0.05 | 1.0 | 2.71 |
| Preparation Example 70 | 91.79 | Copolymer VI 5 | 0.5 | 2.71 |
| Preparation Example 71 | 86.79 | Copolymer VI 10 | 0.5 | 2.71 |
| Preparation Example 72 | 76.79 | Copolymer VI 20 | 0.5 | 2.71 |
| Comparative Example 1 | 97.24 | Copolymer I 0.05 | — | 2.71 |

TABLE 4-continued

| Composition | Base oil | Alphaolefin copolymer | Alkylated phosphonium compound | Additive A |
|---|---|---|---|---|
| Comparative Example 2 | 97.24 | Copolymer II 0.05 | — | 2.71 |
| Comparative Example 3 | 87.29 | Copolymer II 10 | — | 2.71 |
| Comparative Example 4 | 77.29 | Copolymer II 20 | — | 2.71 |
| Comparative Example 5 | 67.29 | Copolymer II 30 | — | 2.71 |
| Comparative Example 6 | 92.29 | Copolymer IV 5 | — | 2.71 |
| Comparative Example 7 | 67.29 | Copolymer V 30 | — | 2.71 |
| Comparative Example 8 | 62.29 | Copolymer V 35 | — | 2.71 |
| Comparative Example 9 | 97.24 | Copolymer VI 0.05 | — | 2.71 |

Preparation Examples 73 to 148 and Comparative Examples to 16. Lubricant Composition for Gear Oil Including Additive B

TABLE 5

| Composition | Base oil | Alphaolefin copolymer | Alkylated phosphonium compound | Additive B |
|---|---|---|---|---|
| Preparation Example 73 | 92.28 | Copolymer I 0.5 | 0.5 | 6.72 |
| Preparation Example 74 | 91.78 | Copolymer I 0.5 | 1.0 | 6.72 |
| Preparation Example 75 | 87.78 | Copolymer I 5 | 0.5 | 6.72 |
| Preparation Example 76 | 87.28 | Copolymer I 5 | 1.0 | 6.72 |
| Preparation Example 77 | 82.28 | Copolymer I 10 | 1.0 | 6.72 |
| Preparation Example 78 | 80.28 | Copolymer I 10 | 3.0 | 6.72 |
| Preparation Example 79 | 72.78 | Copolymer I 20 | 0.5 | 6.72 |
| Preparation Example 80 | 72.28 | Copolymer I 20 | 1.0 | 6.72 |
| Preparation Example 81 | 91.78 | Copolymer II 0.5 | 1.0 | 6.72 |
| Preparation Example 82 | 89.78 | Copolymer II 0.5 | 3.0 | 6.72 |
| Preparation Example 83 | 87.78 | Copolymer II 5 | 0.5 | 6.72 |
| Preparation Example 84 | 87.28 | Copolymer II 5 | 1.0 | 6.72 |
| Preparation Example 85 | 82.28 | Copolymer II 10 | 1.0 | 6.72 |
| Preparation Example 86 | 80.28 | Copolymer II 10 | 3.0 | 6.72 |
| Preparation Example 87 | 70.28 | Copolymer II 20 | 3.0 | 6.72 |
| Preparation Example 88 | 62.78 | Copolymer II 30 | 0.5 | 6.72 |
| Preparation Example 89 | 62.28 | Copolymer II 30 | 1.0 | 6.72 |
| Preparation Example 90 | 60.28 | Copolymer II 30 | 3.0 | 6.72 |
| Preparation Example 91 | 58.28 | Copolymer II 30 | 5.0 | 6.72 |
| Preparation Example 91 | 93.13 | Copolymer III 0.05 | 0.1 | 6.72 |
| Preparation Example 93 | 92.73 | Copolymer III 0.05 | 0.5 | 6.72 |
| Preparation Example 94 | 92.23 | Copolymer III 0.05 | 1.0 | 6.72 |
| Preparation Example 95 | 90.23 | Copolymer III 0.05 | 3.0 | 6.72 |

TABLE 5-continued

| Composition | Base oil | Alphaolefin copolymer | Alkylated phosphonium compound | Additive B |
|---|---|---|---|---|
| Preparation Example 96 | 87.78 | Copolymer III 5 | 0.5 | 6.72 |
| Preparation Example 97 | 83.28 | Copolymer III 5 | 5.0 | 6.72 |
| Preparation Example 98 | 82.78 | Copolymer III 10 | 0.5 | 6.72 |
| Preparation Example 99 | 78.28 | Copolymer III 10 | 5.0 | 6.72 |
| Preparation Example 100 | 72.78 | Copolymer III 20 | 0.5 | 6.72 |
| Preparation Example 101 | 72.28 | Copolymer III 20 | 1.0 | 6.72 |
| Preparation Example 102 | 68.28 | Copolymer III 20 | 5.0 | 6.72 |
| Preparation Example 103 | 58.28 | Copolymer III 30 | 5.0 | 6.72 |
| Preparation Example 104 | 58.18 | Copolymer III 35 | 0.1 | 6.72 |
| Preparation Example 105 | 57.78 | Copolymer III 35 | 0.5 | 6.72 |
| Preparation Example 106 | 57.28 | Copolymer III 35 | 1.0 | 6.72 |
| Preparation Example 107 | 55.28 | Copolymer III 35 | 3.0 | 6.72 |
| Preparation Example 108 | 93.13 | Copolymer IV 0.05 | 0.1 | 6.72 |
| Preparation Example 109 | 92.73 | Copolymer IV 0.05 | 0.5 | 6.72 |
| Preparation Example 110 | 92.23 | Copolymer IV 0.05 | 1.0 | 6.72 |
| Preparation Example 111 | 90.23 | Copolymer IV 0.05 | 3.0 | 6.72 |
| Preparation Example 112 | 88.23 | Copolymer IV 0.05 | 5.0 | 6.72 |
| Preparation Example 113 | 88.18 | Copolymer IV 5 | 0.1 | 6.72 |
| Preparation Example 114 | 85.28 | Copolymer IV 5 | 3.0 | 6.72 |
| Preparation Example 115 | 83.28 | Copolymer IV 5 | 5.0 | 6.72 |
| Preparation Example 116 | 78.28 | Copolymer IV 5 | 10.0 | 6.72 |
| Preparation Example 117 | 83.18 | Copolymer IV 10 | 0.1 | 6.72 |
| Preparation Example 118 | 82.78 | Copolymer IV 10 | 0.5 | 6.72 |
| Preparation Example 119 | 78.28 | Copolymer IV 10 | 5.0 | 6.72 |
| Preparation Example 120 | 73.18 | Copolymer IV 20 | 0.1 | 6.72 |
| Preparation Example 121 | 72.78 | Copolymer IV 20 | 0.5 | 6.72 |
| Preparation Example 122 | 70.28 | Copolymer IV 20 | 3.0 | 6.72 |
| Preparation Example 123 | 93.13 | Copolymer V 0.05 | 0.1 | 6.72 |
| Preparation Example 124 | 92.73 | Copolymer V 0.05 | 0.5 | 6.72 |
| Preparation Example 125 | 92.23 | Copolymer V 0.05 | 1.0 | 6.72 |
| Preparation Example 126 | 90.23 | Copolymer V 0.05 | 3.0 | 6.72 |
| Preparation Example 127 | 88.23 | Copolymer V 0.05 | 5.0 | 6.72 |
| Preparation Example 128 | 88.18 | Copolymer V 5 | 0.1 | 6.72 |
| Preparation Example 129 | 87.78 | Copolymer V 5 | 0.5 | 6.72 |
| Preparation Example 130 | 83.28 | Copolymer V 5 | 5.0 | 6.72 |
| Preparation Example 131 | 82.78 | Copolymer V 10 | 0.5 | 6.72 |
| Preparation Example 132 | 78.28 | Copolymer V 10 | 5.0 | 6.72 |
| Preparation Example 133 | 72.78 | Copolymer V 20 | 0.5 | 6.72 |

TABLE 5-continued

| Composition | Base oil | Alphaolefin copolymer | Alkylated phosphonium compound | Additive B |
|---|---|---|---|---|
| Preparation Example 134 | 72.28 | Copolymer V 20 | 1.0 | 6.72 |
| Preparation Example 135 | 63.18 | Copolymer V 30 | 0.1 | 6.72 |
| Preparation Example 136 | 90.23 | Copolymer VI 0.05 | 3.0 | 6.72 |
| Preparation Example 137 | 88.23 | Copolymer VI 0.05 | 5.0 | 6.72 |
| Preparation Example 138 | 87.78 | Copolymer VI 5 | 0.5 | 6.72 |
| Preparation Example 139 | 85.28 | Copolymer VI 5 | 3.0 | 6.72 |
| Preparation Example 140 | 83.18 | Copolymer VI 10 | 0.1 | 6.72 |
| Preparation Example 141 | 82.28 | Copolymer VI 10 | 1.0 | 6.72 |
| Preparation Example 142 | 78.28 | Copolymer VI 10 | 5.0 | 6.72 |
| Preparation Example 143 | 70.28 | Copolymer VI 20 | 3.0 | 6.72 |
| Preparation Example 144 | 58.18 | Copolymer VI 35 | 0.1 | 6.72 |
| Preparation Example 145 | 57.78 | Copolymer VI 35 | 0.5 | 6.72 |
| Preparation Example 146 | 57.28 | Copolymer VI 35 | 1.0 | 6.72 |
| Preparation Example 147 | 55.28 | Copolymer VI 35 | 3.0 | 6.72 |
| Preparation Example 148 | 53.28 | Copolymer VI 35 | 5.0 | 6.72 |
| Comparative Example 10 | 93.23 | Copolymer IV 0.05 | — | 6.72 |
| Comparative Example 11 | 88.28 | Copolymer IV 5 | — | 6.72 |
| Comparative Example 12 | 83.28 | Copolymer IV 10 | — | 6.72 |
| Comparative Example 13 | 88.28 | Copolymer V 5 | — | 6.72 |
| Comparative Example 14 | 73.28 | Copolymer V 20 | — | 6.72 |
| Comparative Example 15 | 63.28 | Copolymer V 30 | — | 6.72 |
| Comparative Example 16 | 88.28 | Copolymer VI 5 | — | 6.72 |

4. Evaluation of Properties

The properties of the lubricant compositions prepared in Preparation Examples and Comparative Examples were measured as follows. The results are shown in Tables 6 and 7 below.

Friction Coefficient

In the ball-on-disc mode, friction performance was evaluated by sequentially elevating the temperature in increments of 10□ from 40 to 120□ at 50 Hz and comparing the average friction coefficients at individual temperatures. Here, the friction coefficient value decreases with an increase in effectiveness.

Traction Coefficient

The traction coefficient was measured using an MTM instrument made by PCS Instruments. Here, the measurement conditions were fixed at 50N and SRR 50%, and friction and traction were observed depending on changes in temperature. The temperature was varied from 40 to 120□, and the average values were compared.

Wear Resistance

Four steel balls were subjected to friction with the lubricant composition for 60 min under conditions of 20 kg load, 1200 rpm, and 54□, the sizes of wear scars were compared, and evaluation was carried out in accordance with ASTM D4172. Here, the wear scar (average wear scar diameter, μm) value decreases with an increase in effectiveness.

Oxidation Stability

Oxidation stability was measured using an RBOT (Rotational Bomb Oxidation Test) meter in accordance with ASTM D2271.

Friction Loss

As a gear oil rig test, an FZG gear efficiency test was performed. In the FZG efficiency test, the pinion torque was measured through rotation with a motor drive specified depending on the type of oil under conditions in which the temperature of oil was fixed to 100° C. and no load was applied, and thus the pinion torque loss rates of existing oil and the oil using the alphaolefin copolymer and the alkylated phosphonium compound were calculated, and relative values thereof were compared.

TABLE 6

| | SRV Friction Coefficient | MTM Traction Coefficient | 4 Ball Wear (μm) | Oxidation stability | Relative loss (FZG efficiency at 100° C.) |
|---|---|---|---|---|---|
| Preparation Example 1 | 0.701 | 0.598 | 496 | 610 | 1.20 |
| Preparation Example 2 | 0.732 | 0.569 | 477 | 654 | 1.09 |
| Preparation Example 3 | 0.734 | 0.587 | 432 | 523 | 1.16 |
| Preparation Example 4 | 0.735 | 0.544 | 501 | 320 | 1.30 |
| Preparation Example 5 | 0.712 | 0.523 | 665 | 249 | 1.30 |
| Preparation Example 6 | 0.285 | 0.200 | 152 | 1650 | 0.91 |
| Preparation Example 7 | 0.265 | 0.236 | 133 | 1600 | 0.90 |
| Preparation Example 8 | 0.267 | 0.211 | 110 | 2000 | 0.95 |
| Preparation Example 9 | 0.240 | 0.236 | 106 | 2110 | 0.94 |
| Preparation Example 10 | 0.736 | 0.569 | 511 | 333 | 1.15 |
| Preparation Example 11 | 0.239 | 0.207 | 123 | 1840 | 0.91 |
| Preparation Example 12 | 0.257 | 0.217 | 140 | 1680 | 0.92 |
| Preparation Example 13 | 0.745 | 0.564 | 522 | 285 | 1.22 |
| Preparation Example 14 | 0.259 | 0.243 | 147 | 1510 | 0.93 |
| Preparation Example 15 | 0.754 | 0.555 | 536 | 278 | 1.20 |
| Preparation Example 16 | 0.710 | 0.621 | 588 | 299 | 1.18 |
| Preparation Example 17 | 0.768 | 0.561 | 555 | 269 | 1.18 |
| Preparation Example 18 | 0.769 | 0.532 | 622 | 298 | 1.16 |
| Preparation Example 19 | 0.774 | 0.512 | 654 | 277 | 1.09 |
| Preparation Example 20 | 0.744 | 0.533 | 635 | 279 | 1.16 |
| Preparation Example 21 | 0.730 | 0.612 | 598 | 311 | 1.14 |
| Preparation Example 22 | 0.741 | 0.633 | 590 | 312 | 1.16 |
| Preparation Example 23 | 0.76 | 0.685 | 518 | 384 | 1.20 |
| Preparation Example 24 | 0.769 | 0.696 | 523 | 368 | 1.18 |
| Preparation Example 25 | 0.778 | 0.641 | 537 | 321 | 1.14 |
| Preparation Example 26 | 0.792 | 0.621 | 556 | 325 | 1.16 |
| Preparation Example 27 | 0.791 | 0.632 | 631 | 387 | 1.12 |

TABLE 6-continued

| | SRV Friction Coefficient | MTM Traction Coefficient | 4 Ball Wear (μm) | Oxidation stability | Relative loss (FZG efficiency at 100° C.) |
|---|---|---|---|---|---|
| Preparation Example 28 | 0.278 | 0.236 | 107 | 1610 | 0.93 |
| Preparation Example 29 | 0.279 | 0.245 | 108 | 1440 | 0.91 |
| Preparation Example 30 | 0.284 | 0.278 | 121 | 2130 | 0.92 |
| Preparation Example 31 | 0.291 | 0.247 | 122 | 2410 | 0.93 |
| Preparation Example 32 | 0.793 | 0.612 | 623 | 345 | 1.19 |
| Preparation Example 33 | 0.777 | 0.548 | 505 | 269 | 1.16 |
| Preparation Example 34 | 0.269 | 0.219 | 158 | 1780 | 0.95 |
| Preparation Example 35 | 0.264 | 0.209 | 169 | 1790 | 0.93 |
| Preparation Example 36 | 0.797 | 0.587 | 647 | 388 | 1.20 |
| Preparation Example 37 | 0.81 | 0.521 | 644 | 415 | 1.14 |
| Preparation Example 38 | 0.258 | 0.221 | 152 | 1540 | 0.92 |
| Preparation Example 39 | 0.755 | 0.555 | 612 | 321 | 1.30 |
| Preparation Example 40 | 0.841 | 0.623 | 698 | 610 | 1.15 |
| Preparation Example 41 | 0.702 | 0.665 | 678 | 654 | 1.14 |
| Preparation Example 42 | 0.682 | 0.610 | 598 | 523 | 1.16 |
| Preparation Example 43 | 0.713 | 0.587 | 599 | 320 | 1.30 |
| Preparation Example 44 | 0.715 | 0.588 | 587 | 333 | 1.15 |
| Preparation Example 45 | 0.258 | 0.211 | 175 | 2020 | 0.95 |
| Preparation Example 46 | 0.716 | 0.521 | 499 | 285 | 1.22 |
| Preparation Example 47 | 0.269 | 0.207 | 154 | 1650 | 0.92 |
| Preparation Example 48 | 0.717 | 0.569 | 580 | 278 | 1.20 |
| Preparation Example 49 | 0.278 | 0.217 | 135 | 1580 | 0.92 |
| Preparation Example 50 | 0.279 | 0.213 | 108 | 1490 | 0.93 |
| Preparation Example 51 | 0.726 | 0.587 | 590 | 269 | 1.18 |
| Preparation Example 52 | 0.693 | 0.587 | 520 | 495 | 1.15 |
| Preparation Example 53 | 0.231 | 0.247 | 163 | 2456 | 0.94 |
| Preparation Example 54 | 0.691 | 0.587 | 651 | 419 | 1.14 |
| Preparation Example 55 | 0.711 | 0.547 | 587 | 322 | 1.12 |
| Preparation Example 56 | 0.268 | 0.236 | 199 | 1680 | 0.91 |
| Preparation Example 57 | 0.264 | 0.248 | 185 | 2020 | 0.92 |
| Preparation Example 58 | 0.247 | 0.278 | 169 | 2122 | 0.93 |
| Preparation Example 59 | 0.254 | 0.219 | 165 | 1681 | 0.93 |
| Preparation Example 60 | 0.260 | 0.217 | 155 | 1519 | 0.92 |
| Preparation Example 61 | 0.678 | 0.512 | 655 | 279 | 1.16 |
| Preparation Example 62 | 0.621 | 0.547 | 591 | 325 | 1.18 |
| Preparation Example 63 | 0.278 | 0.243 | 123 | 1440 | 0.93 |
| Preparation Example 64 | 0.744 | 0.587 | 478 | 347 | 1.16 |

TABLE 6-continued

| | SRV Friction Coefficient | MTM Traction Coefficient | 4 Ball Wear (μm) | Oxidation stability | Relative loss (FZG efficiency at 100° C.) |
|---|---|---|---|---|---|
| Preparation Example 65 | 0.685 | 0.611 | 664 | 269 | 1.18 |
| Preparation Example 66 | 0.655 | 0.587 | 673 | 396 | 1.16 |
| Preparation Example 67 | 0.745 | 0.587 | 599 | 348 | 1.16 |
| Preparation Example 68 | 0.725 | 0.555 | 568 | 384 | 1.30 |
| Preparation Example 69 | 0.756 | 0.548 | 534 | 368 | 1.15 |
| Preparation Example 70 | 0.291 | 0.245 | 149 | 1810 | 0.91 |
| Preparation Example 71 | 0.269 | 0.278 | 107 | 1790 | 0.92 |
| Preparation Example 72 | 0.284 | 0.256 | 110 | 1540 | 0.94 |
| Comparative Example 1 | 0.721 | 0.589 | 454 | 510 | 1.11 |
| Comparative Example 2 | 0.759 | 0.674 | 505 | 348 | 1.22 |
| Comparative Example 3 | 0.775 | 0.555 | 436 | 258 | 1.30 |
| Comparative Example 4 | 0.811 | 0.588 | 698 | 412 | 1.18 |
| Comparative Example 5 | 0.766 | 0.672 | 664 | 510 | 1.16 |
| Comparative Example 6 | 0.725 | 0.611 | 510 | 465 | 1.30 |
| Comparative Example 7 | 0.68 | 0.563 | 636 | 249 | 1.30 |
| Comparative Example 8 | 0.7 | 0.587 | 597 | 321 | 1.20 |
| Comparative Example 9 | 0.716 | 0.539 | 498 | 396 | 1.30 |

TABLE 7

| | SRV Friction Coefficient | MTM Traction Coefficient | 4 Ball Wear (μm) | Oxidation stability | Relative loss (FZG efficiency at 100□) |
|---|---|---|---|---|---|
| Preparation Example 73 | 0.268 | 0.209 | 122 | 1640 | 0.93 |
| Preparation Example 74 | 0.269 | 0.236 | 132 | 1490 | 0.91 |
| Preparation Example 75 | 0.247 | 0.200 | 164 | 2110 | 0.92 |
| Preparation Example 76 | 0.231 | 0.236 | 176 | 2030 | 0.93 |
| Preparation Example 77 | 0.254 | 0.211 | 161 | 1580 | 0.95 |
| Preparation Example 78 | 0.251 | 0.236 | 196 | 1490 | 0.94 |
| Preparation Example 79 | 0.269 | 0.207 | 193 | 1480 | 0.91 |
| Preparation Example 80 | 0.278 | 0.222 | 190 | 1650 | 0.92 |
| Preparation Example 81 | 0.277 | 0.236 | 167 | 1480 | 0.93 |
| Preparation Example 82 | 0.284 | 0.245 | 189 | 2020 | 0.94 |
| Preparation Example 83 | 0.268 | 0.278 | 107 | 2456 | 0.93 |
| Preparation Example 84 | 0.269 | 0.247 | 108 | 1854 | 0.91 |
| Preparation Example 85 | 0.284 | 0.219 | 121 | 1440 | 0.92 |
| Preparation Example 86 | 0.291 | 0.209 | 122 | 2080 | 0.93 |

TABLE 7-continued

| | SRV Friction Coefficient | MTM Traction Coefficient | 4 Ball Wear (μm) | Oxidation stability | Relative loss (FZG efficiency at 100□) |
|---|---|---|---|---|---|
| Preparation Example 87 | 0.264 | 0.200 | 169 | 1810 | 0.93 |
| Preparation Example 88 | 0.749 | 0.555 | 520 | 298 | 1.12 |
| Preparation Example 89 | 0.748 | 0.569 | 555 | 277 | 1.19 |
| Preparation Example 90 | 0.75 | 0.539 | 562 | 279 | 1.16 |
| Preparation Example 91 | 0.755 | 0.587 | 458 | 249 | 1.30 |
| Preparation Example 91 | 0.798 | 0.639 | 655 | 346 | 1.16 |
| Preparation Example 93 | 0.768 | 0.589 | 636 | 347 | 1.30 |
| Preparation Example 94 | 0.736 | 0.598 | 664 | 258 | 1.15 |
| Preparation Example 95 | 0.747 | 0.569 | 673 | 269 | 1.22 |
| Preparation Example 96 | 0.254 | 0.236 | 194 | 1540 | 0.93 |
| Preparation Example 97 | 0.822 | 0.587 | 676 | 287 | 1.20 |
| Preparation Example 98 | 0.260 | 0.207 | 123 | 1640 | 0.95 |
| Preparation Example 99 | 0.813 | 0.544 | 618 | 288 | 1.18 |
| Preparation Example 100 | 0.269 | 0.222 | 140 | 1490 | 0.93 |
| Preparation Example 101 | 0.278 | 0.219 | 146 | 2020 | 0.91 |
| Preparation Example 102 | 0.702 | 0.569 | 589 | 299 | 1.14 |
| Preparation Example 103 | 0.682 | 0.564 | 597 | 388 | 1.12 |
| Preparation Example 104 | 0.726 | 0.512 | 478 | 347 | 1.22 |
| Preparation Example 105 | 0.735 | 0.533 | 436 | 321 | 1.20 |
| Preparation Example 106 | 0.749 | 0.523 | 505 | 247 | 1.18 |
| Preparation Example 107 | 0.748 | 0.532 | 518 | 258 | 1.14 |
| Preparation Example 108 | 0.693 | 0.548 | 587 | 322 | 1.30 |
| Preparation Example 109 | 0.704 | 0.512 | 541 | 368 | 1.15 |
| Preparation Example 110 | 0.779 | 0.563 | 523 | 388 | 1.22 |
| Preparation Example 111 | 0.77 | 0.611 | 498 | 396 | 1.20 |
| Preparation Example 112 | 0.691 | 0.587 | 599 | 348 | 1.18 |
| Preparation Example 113 | 0.722 | 0.521 | 534 | 368 | 1.12 |
| Preparation Example 114 | 0.284 | 0.209 | 198 | 1650 | 0.92 |
| Preparation Example 115 | 0.715 | 0.555 | 612 | 345 | 1.15 |
| Preparation Example 116 | 0.716 | 0.672 | 647 | 346 | 1.13 |
| Preparation Example 117 | 0.726 | 0.498 | 644 | 258 | 1.30 |
| Preparation Example 118 | 0.291 | 0.278 | 107 | 1580 | 0.94 |
| Preparation Example 119 | 0.745 | 0.623 | 612 | 299 | 1.18 |
| Preparation Example 120 | 0.725 | 0.665 | 664 | 388 | 1.14 |
| Preparation Example 121 | 0.264 | 0.219 | 121 | 1480 | 0.91 |
| Preparation Example 122 | 0.269 | 0.256 | 110 | 1910 | 0.93 |
| Preparation Example 123 | 0.758 | 0.600 | 678 | 415 | 1.19 |

TABLE 7-continued

| | SRV Friction Coefficient | MTM Traction Coefficient | 4 Ball Wear (μm) | Oxidation stability | Relative loss (FZG efficiency at 100□) |
|---|---|---|---|---|---|
| Preparation Example 124 | 0.759 | 0.588 | 598 | 369 | 1.16 |
| Preparation Example 125 | 0.76 | 0.541 | 599 | 358 | 1.30 |
| Preparation Example 126 | 0.769 | 0.563 | 587 | 347 | 1.16 |
| Preparation Example 127 | 0.778 | 0.522 | 499 | 321 | 1.30 |
| Preparation Example 128 | 0.716 | 0.563 | 789 | 317 | 1.20 |
| Preparation Example 129 | 0.268 | 0.221 | 158 | 1480 | 0.93 |
| Preparation Example 130 | 0.713 | 0.532 | 580 | 365 | 1.15 |
| Preparation Example 131 | 0.264 | 0.236 | 174 | 2122 | 0.95 |
| Preparation Example 132 | 0.645 | 0.555 | 589 | 285 | 1.22 |
| Preparation Example 133 | 0.247 | 0.219 | 152 | 2456 | 0.93 |
| Preparation Example 134 | 0.231 | 0.211 | 169 | 1854 | 0.91 |
| Preparation Example 135 | 0.735 | 0.547 | 510 | 250 | 1.14 |
| Preparation Example 136 | 0.758 | 0.512 | 578 | 321 | 1.22 |
| Preparation Example 137 | 0.759 | 0.563 | 579 | 325 | 1.20 |
| Preparation Example 138 | 0.251 | 0.207 | 154 | 2080 | 0.93 |
| Preparation Example 139 | 0.260 | 0.234 | 169 | 2130 | 0.94 |
| Preparation Example 140 | 0.798 | 0.578 | 485 | 287 | 1.22 |
| Preparation Example 141 | 0.259 | 0.209 | 220 | 1810 | 0.93 |
| Preparation Example 142 | 0.822 | 0.601 | 444 | 412 | 1.12 |
| Preparation Example 143 | 0.261 | 0.226 | 226 | 1780 | 0.91 |
| Preparation Example 144 | 0.769 | 0.587 | 584 | 345 | 1.14 |
| Preparation Example 145 | 0.778 | 0.588 | 562 | 346 | 1.12 |
| Preparation Example 146 | 0.792 | 0.541 | 532 | 347 | 1.19 |
| Preparation Example 147 | 0.791 | 0.513 | 521 | 258 | 1.16 |
| Preparation Example 148 | 0.793 | 0.555 | 511 | 269 | 1.30 |
| Comparative Example 10 | 0.725 | 0.555 | 651 | 269 | 1.16 |
| Comparative Example 11 | 0.711 | 0.588 | 568 | 384 | 1.14 |
| Comparative Example 12 | 0.717 | 0.499 | 698 | 347 | 1.16 |
| Comparative Example 13 | 0.715 | 0.543 | 590 | 399 | 1.22 |
| Comparative Example 14 | 0.749 | 0.555 | 587 | 321 | 1.19 |
| Comparative Example 15 | 0.646 | 0.569 | 523 | 278 | 1.20 |
| Comparative Example 16 | 0.76 | 0.611 | 624 | 387 | 1.18 |

As is apparent from Tables 6 and 7, the lubricant compositions including the liquid olefin copolymer and the alkylated phosphonium compound within the amount ranges of the present invention were significantly reduced in wear scar and friction coefficient compared to the lubricant compositions of Comparative Examples, and also exhibited superior oxidation stability.

Moreover, an efficiency improvement of at least 5 to 12% in the FZG gear efficiency test resulted, indicating that, even in practical use, the lubricant composition of the present invention was capable of reducing gear loss, thereby significantly improving fuel economy or energy-saving effects.

Therefore, it is concluded that the lubricant composition of the present invention is improved from the aspects of friction characteristics and stability and thus is suitable for use in gear oil.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lubricant composition, comprising:

70.28 to 95.79% by weight of a base oil, 0.5 to 20% by weight of a liquid olefin copolymer, and 0.5 to 3.0% by weight of an alkylated phosphonium compound, wherein the base oil is at least one selected from the group consisting of mineral oil, polyalphaolefin (PAO), and ester, the liquid olefin copolymer has a coefficient of thermal expansion of 3.0 to 3.8, and the alkylated phosphonium compound is at least one selected from the group consisting of tetraoctylated phosphonium bis-ethylhexyl phosphate, tributyltetradecylphosphonium bis(2-ethylhexyl)phosphate, tetraethylphosphonium bis(2-ethylhexyl)phosphate, and tributylphosphonium bis(2-ethylhexly)phosphate, and wherein the lubricant composition has a SRV friction coefficient of 0.231 to 0.291.

2. The lubricant composition of claim 1, wherein the liquid olefin copolymer is prepared by copolymerizing ethylene and alphaolefin using a single-site catalyst system.

3. The lubricant composition of claim 2, wherein the single-site catalyst system includes a metallocene catalyst, an organometallic compound and an ionic compound.

4. The lubricant composition of claim 1, wherein the liquid olefin copolymer has a bromine number of 0.1 or less.

5. The lubricant composition of claim 1, further comprising an additive selected from the group consisting of an antioxidant, a metal cleaner, an anticorrosive agent, a foam inhibitor, a pour-point depressant, a viscosity modifier, a wear-resistant agent, and combinations thereof.

6. The lubricant composition of claim 1, wherein the lubricant composition has a traction coefficient of 0.15 to 0.3.

7. The lubricant composition of claim 1, wherein the lubricant composition has a pinion torque loss rate due to friction of less than 1% in an FZG gear efficiency test.

8. The lubricant composition of claim 1, wherein the lubricant composition is used as gear oil.

* * * * *